United States Patent [19]

Payton

[11] 4,043,088

[45] Aug. 23, 1977

[54] TRAILER SKIRTING

[75] Inventor: Edward L. Payton, South Bend, Ind.

[73] Assignee: Mastic Corporation, South Bend, Ind.

[21] Appl. No.: 448,523

[22] Filed: Mar. 6, 1974

[51] Int. Cl.[2] ..... E04C 2/32; E02D 27/00

[52] U.S. Cl. ..... 52/169.9; 52/529; 52/DIG. 3

[58] Field of Search ..... 52/DIG. 3, 169, 529–533

[56] References Cited

U.S. PATENT DOCUMENTS

| | | | |
|---|---|---|---|
| 3,131,794 | 5/1964 | Bender | 52/529 |
| 3,233,382 | 2/1966 | Graveley | 52/531 |
| 3,318,060 | 5/1967 | Collins | 52/531 |
| 3,827,201 | 8/1974 | Struben | 52/169 |

*Primary Examiner*—James L. Ridgill, Jr.
*Attorney, Agent, or Firm*—Oltsch & Knoblock

[57] ABSTRACT

Skirting which is utilized around the base of a mobile home or a similar statically supported trailer and which includes a plurality of vertical panels interlocked at corresponding overlapping side edges in a manner which prevents separation of the panels during their vibratory movement due to the wind.

4 Claims, 7 Drawing Figures

Fig. 1
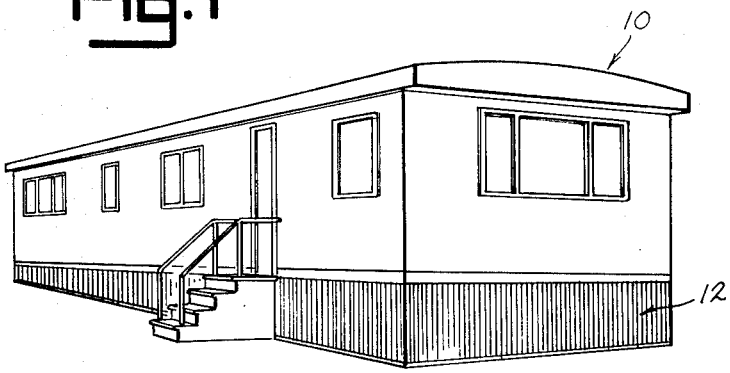
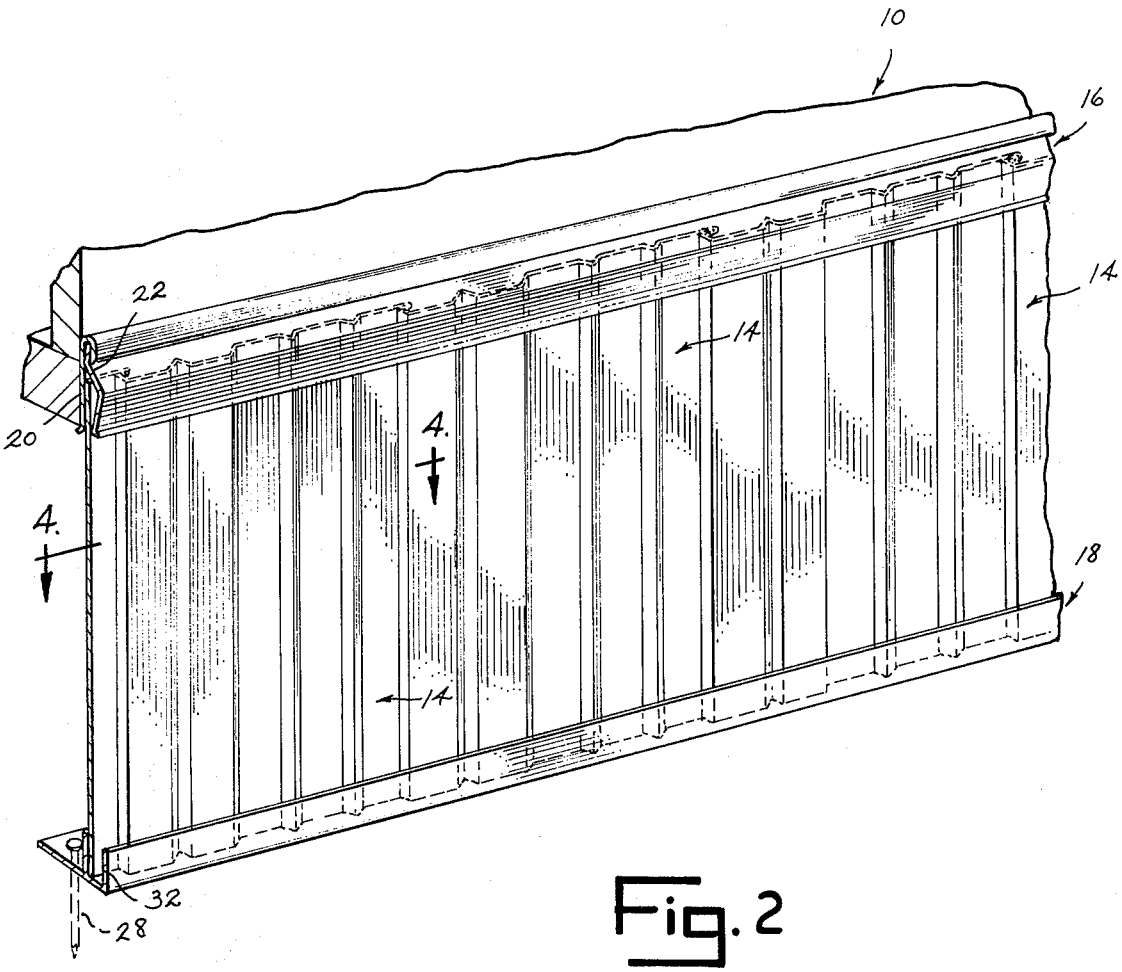
Fig. 2

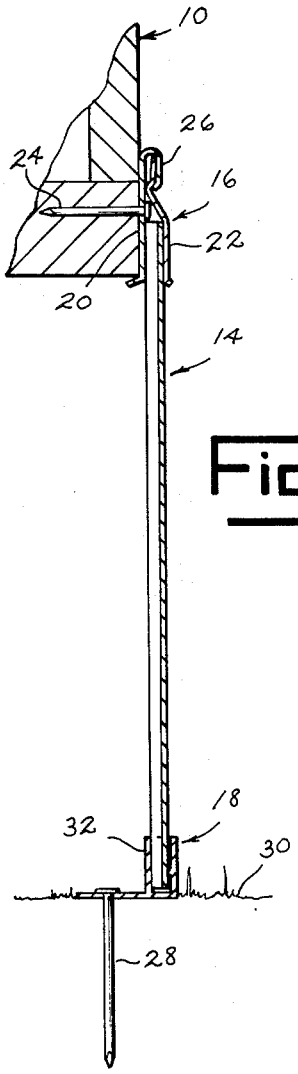
Fig. 3
Fig. 5
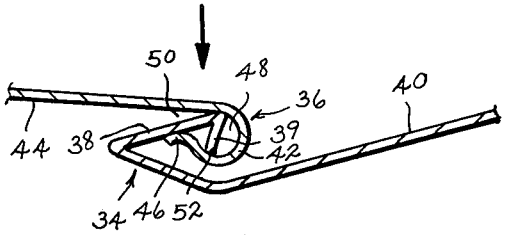
Fig. 6
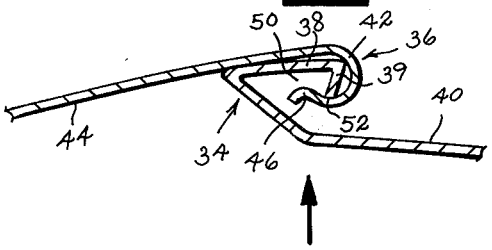
Fig. 4A
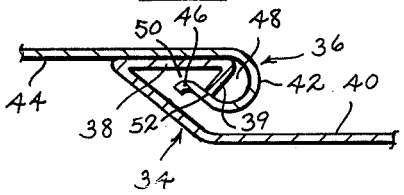
Fig. 4
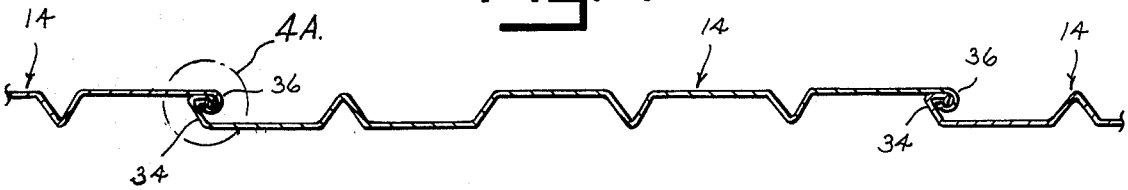

TRAILER SKIRTING

SUMMARY OF THE INVENTION

This invention relates to skirting for a statically supported trailer, such as a mobile home located in a trailer park.

The skirting of this invention includes a plurality of vertically oriented panels which have overlapping, interlocking side edges and which are supported at the upper margins by retainer means secured to the trailer and at the lower margins by retainer means secured to the underlying foundation. The interlocking side edges of each pair of adjacent panels include interfering flange and channel parts which wedge against one another upon wind-caused flexing movement of the panels at the side edges to prevent separation or blow out of the panels between the retainer means.

Additionally, the upper retainer means secured to the trailer includes a cooperating part by which the upper margin of a selected panel can be freed to permit the panel to be withdrawn telescopically upwardly between other panels so as to form an opening within the skirt to allow access under the trailer or to allow for the repair of the panel.

Accordingly, it is an object of this invention to provide skirting for a trailer which includes a plurality of interlocked panels supported at their upper and lower margins.

Another object of this invention is to provide skirting which is for a trailer and which includes a plurality of vertically oriented panels having interlocking side edges having interfering parts preventing blow out of the panels during flexing movement.

Still another object of this invention is to provide skirting which is for a trailer and which is of a construction enabling ready access to the crawl space beneath the trailer.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 1 is a perspective view of a trailer having the skirting of this invention applied thereto.

FIG. 2 is a fragmentary perspective view of the skirting as applied to the trailer of FIG. 1.

FIG. 3 is a vertical sectional view in fragmentary form of the skirting as applied to the trailer of FIG. 1.

FIG. 4 is a horizontal sectional view taken along line 4—4 of FIG. 2.

FIG. 4A is an enlarged detail view of the interlocking side edges of the panel members of the skirting taken within broken line 4A of FIG. 4.

FIG. 5 is a sectional view of the interlocking side edges of two panels of the trailer skirting with the panels shown in an outwardly flexed position.

FIG. 6 is a sectional view of the interlocking side edges of two panels of the trailer skirting showing the panels in an inwardly flexed position.

DESCRIPTION OF THE PREFERRED EMBODIMENT

The preferred embodiment illustrated is not intended to be exhaustive or to limit the invention to the precise form disclosed. It has been chosen and described in order to best explain the principles of the invention and its application and practical use to thereby enable others skilled in the art to best utilize the invention.

In FIG. 1 a mobile home 10 is shown resting statically upon the ground with the skirting 12 of this invention extending between the lower edge of the mobile home and the ground about all sides of the home. Skirting 12 includes a plurality of vertical panels 14 which are supported between an upper retainer 16 and a lower retainer 18.

Upper retainer 16 is secured to the lower edge of mobile home 10 and consists of two cooperating parts, a backing member 20 and a cover member 22. Backing member 20 is secured to the lower edge of the home by nails 24 or similar securement means and includes a return bent lip 26 formed at its upper edge. Cover member 22 overlies backing member 20 and has its upper margin fitted removably under lip 26 of the backing member. The upper margins of panels 14 fit between backing member 20 and cover member 22 with the cover member flexed to urge the panels against the backing member. Lower retainer 18 is located in general longitudinal alignment under upper retainer 16 and is secured by nails 28 or similar fastening means to the ground 30 or other type foundation beneath mobile home 10. Lower retainer 18 includes a U-shaped channel portion 32 into which the lower margins of panels 14 are fitted.

Upper retainer 16 and lower retainer 18 serve as the sole means for supporting interlocking panels 14 along each side of the mobile home. To add rigidity to panels 14, the panels may be formed with ribs or corrugations as shown. The construction of the trailer skirting thus far described is representative of the design of commercially available skirting.

Of principal inventive significance in this invention is the interlock between adjacent panels 14. This interlock prevents blow out or separation of the panels during the wind-caused flexing thereof. Each panel 14 includes parallel vertical side edges 34 and 36. Side edge 34 of each panel includes a flange 38 which projects rearwardly of the panel and which overlies the panel's rear face 40. Each flange 38 terminates in a forwardly directed return bent lip 39 which projects at an acute angle to the flange. The opposite side edge 36 of each panel 14 is formed into an arcuate bend 42 which overlies the panel's front face 44. Each bend 42 terminates in an outturned arcuate lip 46 and in conjunction with front face 44 of the panel forms a part-circular channel 48 which extends the length of side edge 36 of the panel and which has a restricted opening 50 therein.

In applying skirting 12 to mobile home 10, the backing member 20 of upper retainer 16 and the lower retainer 18 are first attached to the home and ground 30. Panels 14 are then interlocked together by having flange 38 and lip 39 along side edge 34 of each panel snap fitted into the channel 48 through opening 50 therein at side edge 36 of the next panel. The interlocked panels are then positioned with their lower margins fitted into channel portion 32 of the lower retainer 18 and with their upper margins contacting and overlying the lower edge portion of backing member 20 of upper retainer 16. Cover member 22 of upper retainer 16 is then placed over the upper margins of the interlocked panels 14 and snap fitted upwardly under lip 26 of the backing member 20, causing panels 14 to be secured in position.

The interlocking arrangement between side edges 34 and 36 of adjacent panels 14 during a calm or no wind situation is best illustrated in FIG. 4A. When the interlocked retainer support panels 14 are subjected to a wind they are caused to flex or bend about their locked edges 34 and 36 as illustrated in FIGS. 5 and 6. In each of the flexed positions shown in FIGS. 5 and 6 it will be noted that end edge 52 of flange 39 forming a part of side edge 34 of one panel contacts the inner surface of bend 42 forming channel 48 of side edge 36 of the adjacent panel. This interfering fit between flange 39 and bend 42 substantially prevents separation of the interlocked panels due to vibratory wind action. Additionally, in the positions illustrated in FIGS. 4A, 5 and 6, it is to be noted that end edge 52 of flange 39 projects at all times forwardly of the connection of lip 46 to bend 42, thus assuring an interfering fit between interlocking panels along their respective side edges 34 and 36 at all times.

When it is desired to remove one or more panels 14 from skirting 12, such as when access to the crawl space beneath mobile home 10 is needed or when it is necessary to replace or repair a panel, cover member 22 of upper retainer 16 at its lower edge portion is bent outwardly to expose the upper margin of the selected panel or panels to be removed. Once the upper margin of a selected panel has been exposed, the panel can be slid upwardly and removed telescopically from its interlock with the adjacently interfitting side panels. When the removed panel is to be replaced, it can be telescopically interfitted into an interlocked arrangement with the two adjacent side panels.

Panels 14 and upper retainer 16 and lower retainer 18 may all be formed of a flexible shape-retaining material such as polyvinylchloride and may be of an extruded, post-formed construction.

It is to be understood that the invention is not to be limited to the details above given but may be modified within the scope of the appended claims.

What I claim is:

1. Skirting for a trailer statically supported upon a foundation and having a lower peripheral edge spaced above said foundation, said skirting including a plurality of vertically oriented panels each having parallel side edges and upper and lower marginal portions, an upper retainer means secured to said trailer lower edge, a lower retainer means secured to said foundation and located under said retainer means, said upper marginal portions of the panels anchored by said upper retainer means, said lower marginal portions of the panels anchored by said lower retainer means, the improvement wherein each panel has front and back faces and is formed of a flexible shape-retaining material, an arcuate bend extending from one side edge of each panel, said bend being formed over said front face of the panel and terminating adjacent said front face in an outturned lip, said bend forming a part-circular channel in conjunction with said front face which extends the length of said one side edge of the panel, said lip defining a restricted opening into said channel at said front face, a flange extending from the other side edge of each panel, said flange projecting rearwardly of the panel and spacedly overlying the rear face thereof, said flange terminating in a return bent lip located between said flange and rear face, said return bent lip projecting at an acute angle to said flange, the flange of one said panel at the other side edge thereof overlying the front face of an adjacent panel at the one side edge thereof and extending through the channel opening and under the bend at said adjacent panel one side edge, the return bent lip of said one panel projecting forwardly of the front face of said adjacent panel and terminating within the channel and forwardly of the connection of the outturned lip to such channel of said adjacent panel to interlock said one panel and adjacent panel together against lateral separation.

2. The skirting of claim 1 wherein said return bent lip of said one panel contacts the bend of said adjacent panel in all positions of said one and adjacent panels when flexed about said interlocked side edges thereof.

3. The skirting of claim 2 wherein said one panel flange contacts said adjacent panel front face.

4. The skirting of claim 3 wherein said flange and return bent lip of said one panel are snap fitted into the channel of said adjacent panel.

* * * * *